US006102769A

United States Patent [19]

Huang

[11] Patent Number: 6,102,769

[45] Date of Patent: Aug. 15, 2000

[54] HULA HOOP

[75] Inventor: Yu-Yuan Huang, Taichung, Taiwan

[73] Assignee: Li-Chu Wu, Taipei Hsien, Taiwan

[21] Appl. No.: 09/383,416

[22] Filed: Aug. 26, 1999

[51] Int. Cl.[7] ..... A63H 1/00; A61H 15/00

[52] U.S. Cl. ..... 446/236; 601/132

[58] Field of Search ..... 446/236; 273/336; 601/132, 118, 128, 129, 130, 131; 24/116 A; 59/2; 63/3, 3.1, 3.2

*Primary Examiner*—Sam Rimell
*Assistant Examiner*—Urszula M Cegielnik
*Attorney, Agent, or Firm*—Browdy and Neimark

[57] ABSTRACT

A hula hoop is formed of a plurality of spherical bodies, with each having a main body and a pliable connection rod which is provided at the free end thereof with a retaining block. The main body is provided with a receiving slot opposite to the connection rod and extending toward the center of the main body, and an insertion slot extending toward the receiving slot. The insertion slot is provided with a retaining slot corresponding to the center of the main body and greater in inner diameter than the insertion slot. The insertion slot has a width greater than a thickness of the connection rod. The hula hoop is formed of the spherical bodies such that the connection rod of one of the spherical bodies is received in the receiving slot of another one of the spherical bodies via the insertion slot of the another one spherical body, and that the retaining block is retained in the retaining slot.

8 Claims, 6 Drawing Sheets

HULA HOOP

FIELD OF THE INVENTION

The present invention relates generally to a hula hoop, and more particularly to a hula hoop formed of a plurality of spherical bodies which are strung together.

BACKGROUND OF THE INVENTION

The original hula hoop is a light hoop twirled around the body of a person in play or exercise by rotating the hips of the person. The original hula hoop has a fixed form and thus takes up a relatively large space in storage.

As shown in FIG. 1, an improved hula hoop 1 of the prior art is formed of a plurality of spherical bodies 3 of a wooden material. The spherical bodies 3 are strung by a rope 5 to form a soft hula hoop, which works in the same way as described above. However, the prior art hula hoop 1 can be easily stored in a small space. In spite of such an advantage over the original hula hoop, the prior art hula hoop 1 has certain drawbacks. In the first place, the prior art hula hoop 1 is not cost-effective in view of the high cost that is involved in making the spherical bodies 3 by turning. In addition, the work of stringing the spherical bodies 3 is rather labor-intensive. Moreover, the length of the rope 5 and the number of the spherical bodies 3 of the hula hoop 1 are fixed. As a result, the hula hoop 1 can not be used by persons of all sizes. The prior art hula hoop 1 has a poor pliability, which tends to cause the spherical bodies 3 to crowd together in the midst of action.

SUMMARY OF THE INVENTION

It is therefore the primary objective of the present invention to provide a hula hoop formed of a string of spherical bodies which are made at a relatively low cost.

It is another objective of the present invention to provide a hula hoop which is formed of a string of spherical bodies and is adjustable in length as desired.

It is still another objective of the present invention to provide a hula hoop which is formed of a string of spherical bodies and is provided with a relatively greater pliability.

In keeping with the principle of the present invention, the foregoing objectives of the present invention are attained by a hula hoop formed of a string of spherical bodies comprising a main body having a connection rod extending in the direction away from the main body. The connection rod is provided at the free end thereof with a retaining block. The main body is provided with a receiving slot opposite in location to the connection rod and smaller in size than the retaining block. The main body is further provided with an insertion slot extending toward the receiving slot and having a retaining slot corresponding in location to the center of the main body. The insertion slot has a width slightly greater than the thickness of the connection rod. A plurality of the spherical bodies are strung such that the connection rod of one of the spherical bodies is inserted into the insertion slot of another one of the spherical bodies, and that the retaining block of the connection rod is retained in the retaining slot.

The foregoing objectives, features, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
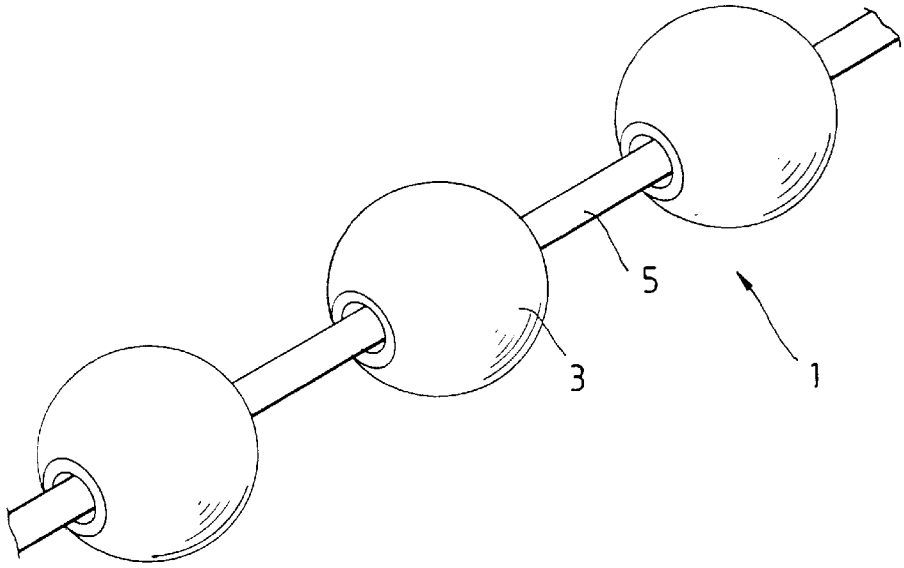
FIG. 1 PRIOR ART
FIG. 1 shows a partial schematic view of a hula hoop of the prior art.
Figure 2:
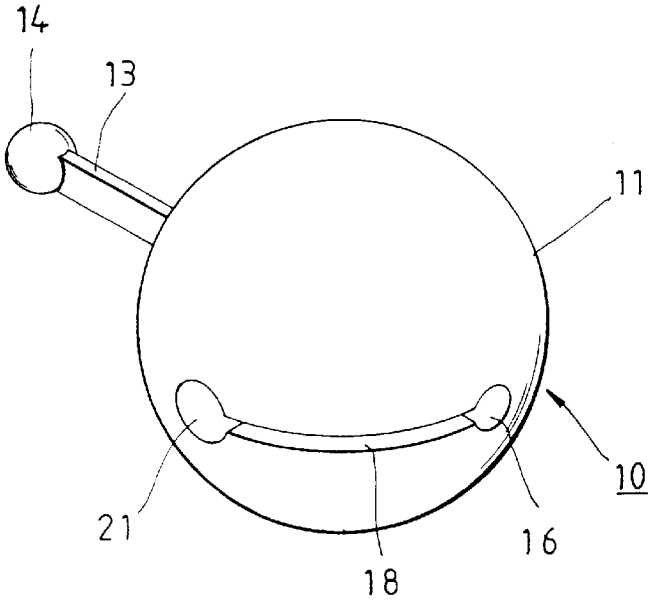
FIG. 2 shows a perspective view of a spherical body of a hula hoop of a first preferred embodiment of the present invention.
Figure 3:
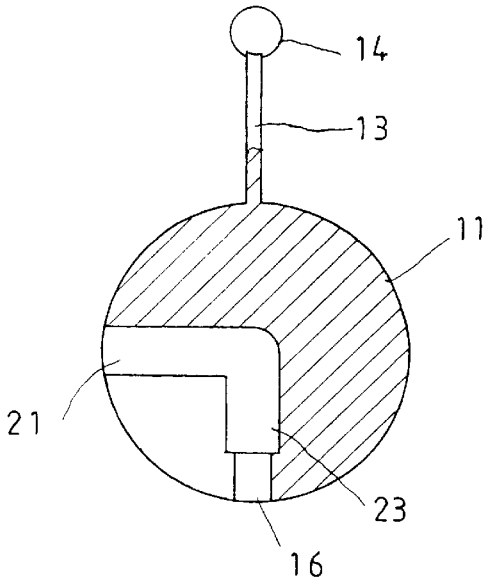
FIG. 3 shows a side sectional view of the first preferred embodiment of the present invention.

As shown in FIGS. 2 and 3, a hula hoop spherical body 10 embodied in the present invention has a spherical main body 11 which is provided with a pliable connection rod 13 of a length and extending in the direction away from the main body 11. The connection rod 13 is provided at the free end thereof with a spherical retaining block 14 fastened therewith.

The main body 11 is further provided with a receiving slot 16 opposite in location to the connection rod 13 and extending in the direction toward the center of the main body 11. The receiving slot 16 has an inner diameter smaller than the diameter of the retaining block 14. The main body 11 is further provided with an insertion slot 18 extending toward the receiving slot 16. The insertion slot 18 is provided with a retaining slot 21 corresponding in location to the center of the main body 11 and greater in inner diameter than the insertion slot 18. The retaining slot 16 is round in its cross section. The insertion slot 18 has a width slightly greater than the thickness of the connection rod 13. The connection rod 13 is flat and has a wide side and a narrow side.

The main body 11 is provided at the center thereof with a position confining slot 23 of a length smaller than the length of the receiving slot 16 and extending in the direction toward the receiving slot 16. The position confining slot 23 has an inner diameter slightly greater than the diameter of the retaining block 14.

Figure 4:
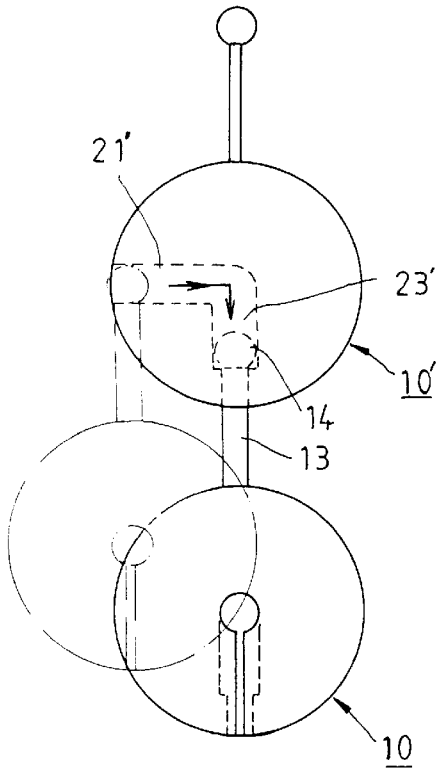
FIG. 4 shows a schematic view of the assembly of the first preferred embodiment of the present invention.

As shown in FIG. 4, a first spherical body 10 and a second spherical body 10' are strung together such that the connection rod 13 and the retaining block 14 of the first spherical body 10 are inserted into the receiving slot 16' of the second spherical body 10' via the insertion slot (not shown in the drawing) of the second spherical body 10'. As the first spherical body 10 is pulled backward, the retaining block 14 of the first spherical body 10 is retained in the position confining slot 23' of the second spherical body 10'. Depending on the number of the spherical body 10, a hula hoop of a desired length can be formed.

Figure 5:
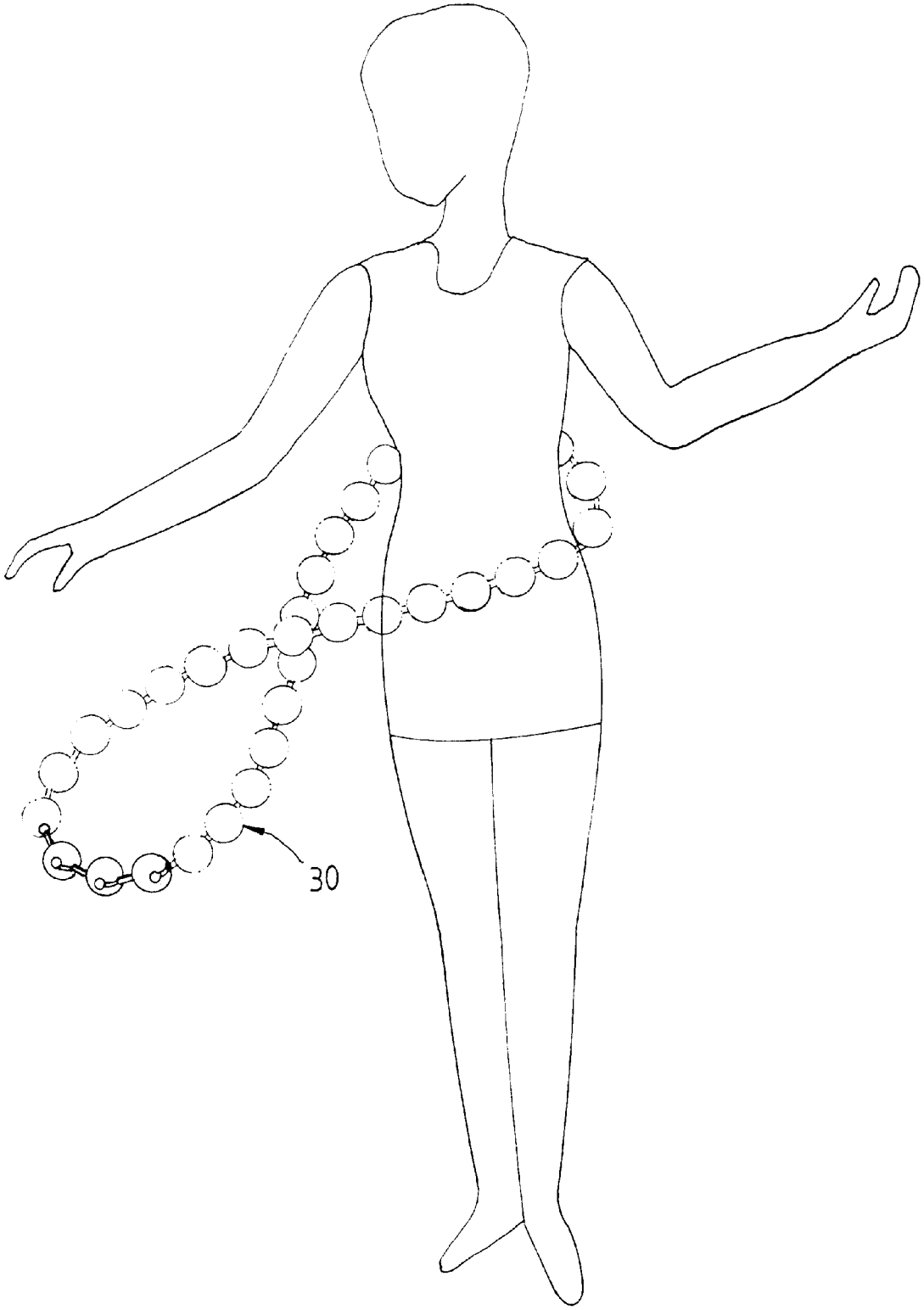
FIG. 5 shows a schematic view of the first preferred embodiment of the present invention in use.
Figure 6:
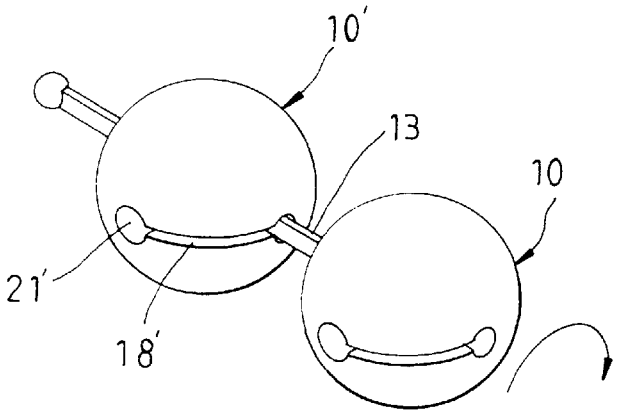
FIG. 6 shows a schematic view of the relationship between the connection rod of one spherical body with another spherical body of the first preferred embodiment of the present invention.

As shown in FIG. 5, a hula hoop 30 of the present invention is twirled around the body of a person in play or exercise by rotating the hips of the person. Now referring to FIG. 6, it is illustrated that there is a pulling force between the first spherical body 10 and the second spherical body 10'. When the hula hoop 30 is spun, there is an angular displacement between the first spherical body 10 and the second spherical body 10'. In view of the retaining block (not shown in the drawing) being retained in the position confining slot 23' without being forced back to the retaining slot 21' of the second spherical body 10', the connection rod 13 is caused to turn due to the angular displacement between the spherical bodies. As a result, the retaining block 14 does not become disengaged with the retaining slot 21. In the meantime, the wider side of the connection rod 13 faces the insertion slot 18' such that the narrow side of the connection rod 13 does not slip out of the insertion slot 18'. As a result, the spherical bodies of the hula hoop 30 stick together at the time when the hula hoop 30 is twirled around the body of a person.

The spherical bodies of the hula hoop 30 can be separated by rotating the main body 11 such that the narrow side of the connection rod 13 is corresponding to the insertion slot 18' of the second spherical body 10'. Thereafter, the main body 11 is pushed such that the retaining block is displaced in the position confining slot 23' to become corresponding in location to the retaining slot 21'. The connection rod 13 and the retaining block 14 are then moved out of the second spherical body 10' via the insertion slot 18' and the retaining slot 21'.

Figure 7:
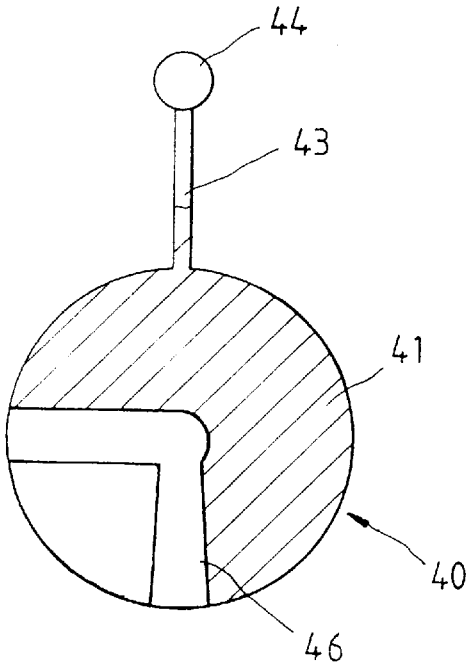
FIG. 7 shows a side sectional view of a second preferred embodiment of the present invention.

As shown in FIG. 7, a spherical body 40 of the second preferred embodiment of the present invention is different from the spherical body 10 of the first preferred embodiment of the present invention. The former 40 has a main body 41 devoid of the position confining slot. The main body 41 is provided with a receiving slot 46 which becomes progressively greater in inner diameter from the inner end thereof toward the outer end thereof. In combination, the retaining block 44 of one spherical body 40 is retained in the retaining slot of another spherical body contiguous to the one spherical body 40. The one spherical body 40 is turned in relation to the another spherical body such that the wide side of the connection rod 43 is corresponding to the insertion slot at such time when the hula hoop is at work. As a result, two spherical bodies remain in a close association when they are at work.

Figure 8:
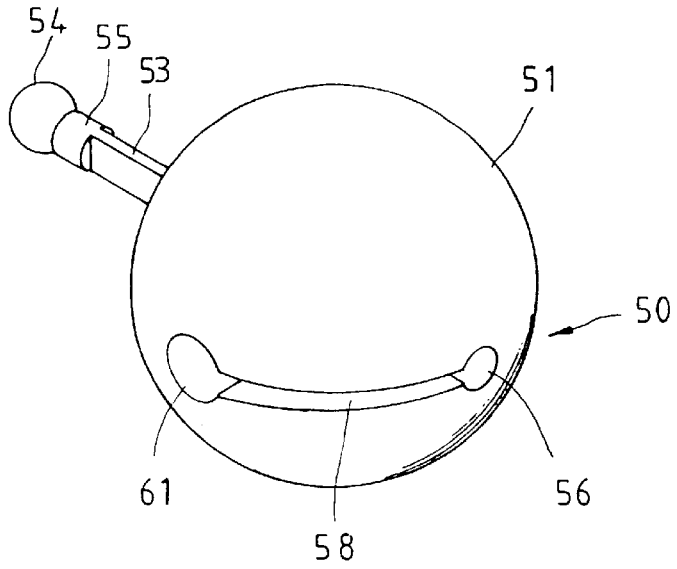
FIG. 8 shows a perspective view of a third preferred embodiment of the present invention.
Figure 9:
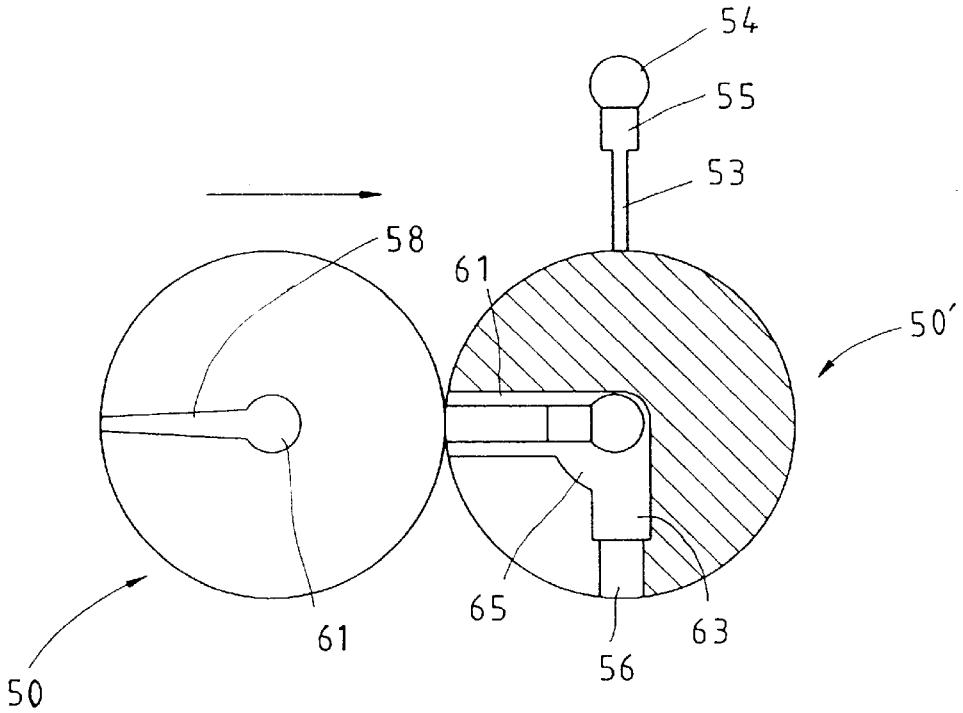
FIG. 9 shows a schematic view of a fourth preferred embodiment of the present invention.
Figure 10:
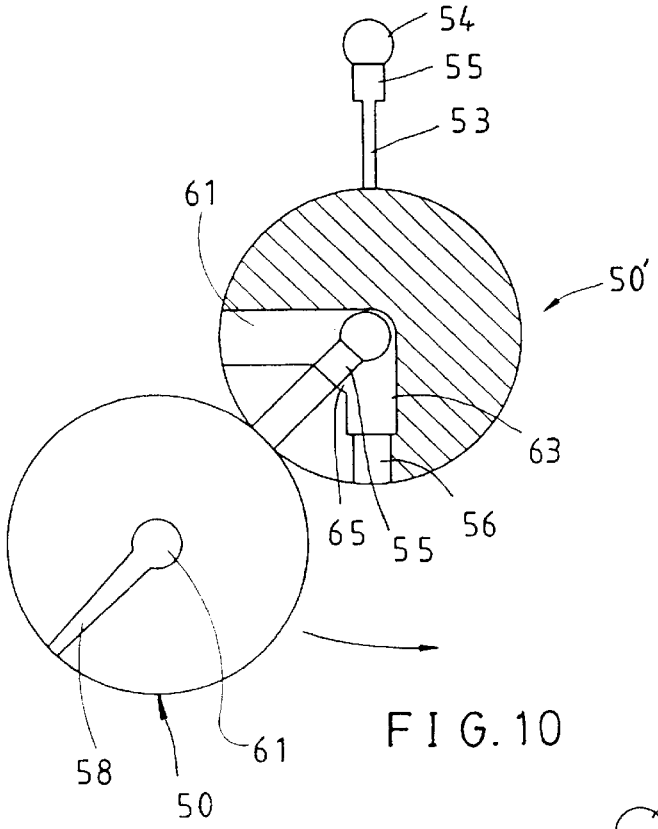
FIG. 10 shows a schematic view of a fifth preferred embodiment of the present invention.
Figure 11:
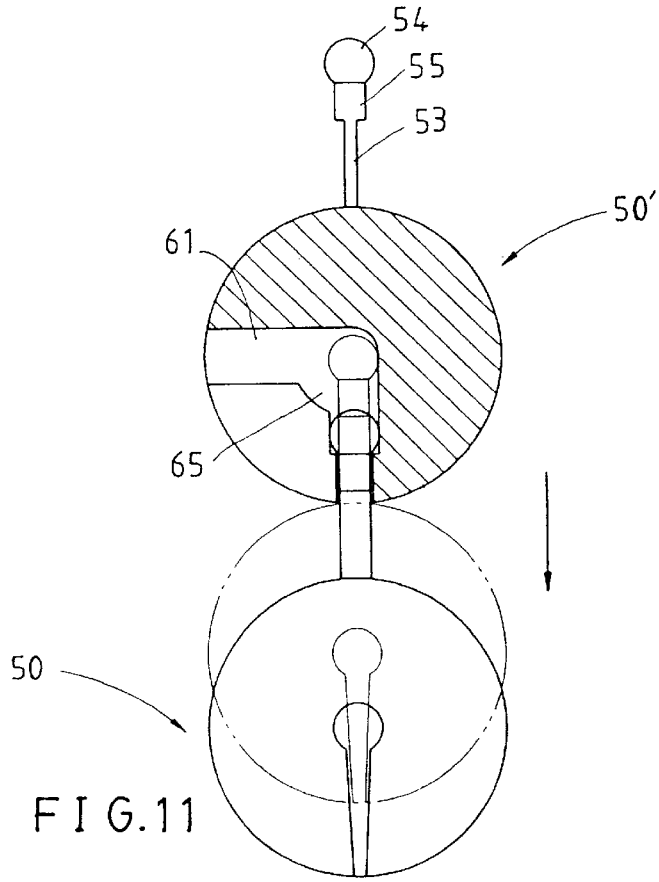
FIG. 11 shows a schematic view of a sixth preferred embodiment of the present invention.

As shown in FIG. 8, a spherical body 50 of the third preferred embodiment of the present invention is different from the spherical body 10 of the first preferred embodiment in design in that the former 50 has a main body 51 which is provided with a connection rod 53 and a retaining block 54 having a stop block 55 of a predetermined length and extending toward the main body. The stop block 55 has a thickness greater than the thickness of the connection rod 53. The stop block 55 is round in its cross section and has a diameter greater than the thickness of the connection rod 53 and the width of the insertion slot 58. The stop block 55 is smaller than the retaining block 54. As shown in FIG. 9, the position confining slot 63 extends toward the retaining slot 61 to form a rotational space 65 of a sectoral shape to facilitate the passing of the stop block 55. In combination the connection rod 53 and the retaining block 54 of one spherical body 50 is vertically inserted into the retaining slot 61 of another spherical body 50' contiguous to the spherical body 50. Thereafter, the first spherical body 50 is turned along the center of the second spherical body 50' for angle of 90 degrees such that the connection rods 53 of the first spherical body 50 and the second spherical body 50' are arranged in alignment. When the stop block 55 is turned, it moves through the rotational space 65 to locate in the position confining slot 63, as shown in FIG. 10. Thereafter, the first spherical body 50 is pulled outward so as to cause the stop block 55 to move into the receiving slot 56, as shown in FIG. 11. The two spherical bodies 50 and 50' are thus kept in a close association. The two united spherical bodies 50 and 50' can be separated from each other by following the above-described operational steps in reverse.

It is therefore readily apparent that the present invention had advantages over the prior art. In the first place, the spherical bodies 10 of the present invention can be made economically in quantity by injection molding. The spherical bodies 10 may be sold at retail and put together by the consumer to form a hula hoop of a desired length. In light of the spherical bodies of the hula hoop of the present invention being kept apart at an interval by the connection rods of an excellent pliability, the hula hoop of the present invention is provided with an excellent pliability.

What is claimed is:

1. A hula hoop formed of a series of spherical bodies, wherein said spherical bodies have a spherical main body and a pliable connection rod of a length and extending from said main body in a direction away from said main body, said connection rod provided at a free end thereof with a retaining block whereby said main body is provided with a receiving slot opposite in location to said connection rod and extending toward a center of said main body and is further provided with an insertion slot extending toward said receiving slot, said insertion slot being provided with a retaining slot corresponding in location to the center of said main body and greater in inner diameter than said insertion slot, said insertion slot having a width greater than a thickness of said connection rod; and wherein the hula hoop is formed of a series of said spherical bodies such that said connection rod of one of said spherical bodies is received in said receiving slot of another one of said spherical bodies via said insertion slot of said another one spherical body, and that said retaining block is retained in said retaining slot.

2. The hula hoop as defined in claim 1, wherein said retaining block has a spherical shape; and wherein said retaining slot has a round cross section.

3. The hula hoop as defined in claim 1, wherein said main body is provided with a position confining slot extending from the center of said main body along the direction of said receiving slot whereby said position confining slot is greater in inner diameter than said receiving slot.

4. The hula hoop as defined in claim 3, wherein said retaining block has a spherical shape; wherein said retaining slot has a round cross section; and wherein said position confining slot has a round cross section.

5. The hula hoop as defined in claim 1, wherein said receiving slot is progressively greater in inner diameter from an inner end thereof toward an outer end thereof.

6. A hula hoop formed of a series of spherical bodies, wherein said spherical bodies have a spherical main body and a pliable connection rod of a length and extending from said main body in a direction away from said main body, said connection rod provided at a free end thereof with a retaining block whereby said retaining block is provided with a stop block extending from said retaining block along said connection rod toward said main body, said stop block having a thickness greater than a thickness of said connection rod and smaller than a thickness of said retaining block, said main body being provided with a receiving slot opposite in location to said connection rod and extending toward a center of said main body, said main body further being provided with an insertion slot extending toward said receiving slot, said insertion slot being provided with a retaining slot corresponding in location to the center of said main body and greater in inner diameter than said insertion slot, said main body further provided with a position confining slot extending from the center of said main body along the direction of said receiving slot and greater in inner diameter than said receiving slot, said main body further provided with a rotational space located between said position confining slot and said retaining slot, said insertion slot having a width greater than a thickness of said connection rod, said main body further provided with a stop slot located between said receiving slot and said position confining slot whereby said stop slot is intermediate in inner diameter between said receiving slot and said position confining slot; and wherein the hula hoop is formed of a series of said spherical bodies such that said connection rod of one of said spherical bodies is received in said receiving slot of another one of said spherical bodies via said insertion slot of said another one spherical body, and that said retaining block is retained in said retaining slot.

7. The hula hoop as defined in claim 6, wherein said stop block has a round cross section.

8. The hula hoop as defined in claim 6, wherein said rotational space is a sectoral space extending from said position confining slot toward said retaining slot.

* * * * *